US007380427B2

(12) United States Patent
Elles et al.

(10) Patent No.: US 7,380,427 B2
(45) Date of Patent: Jun. 3, 2008

(54) COMBINATION LOCK WITH PASS-KEY OVERRIDE

(75) Inventors: Daniel G. Elles, Conifer, CO (US); Jonathan Ted Chopper, Arvada, CO (US)

(73) Assignee: Samsonite Corporation, Mansfield, MA (US)

( * ) Notice: Subject to any disclaimer, the term of this patent is extended or adjusted under 35 U.S.C. 154(b) by 0 days.

(21) Appl. No.: 11/377,539

(22) Filed: Mar. 16, 2006

(65) Prior Publication Data

US 2006/0248930 A1 Nov. 9, 2006

Related U.S. Application Data

(60) Provisional application No. 60/662,565, filed on Mar. 17, 2005.

(51) Int. Cl.
*E05B 37/00* (2006.01)
*E05B 65/52* (2006.01)

(52) U.S. Cl. ..... 70/285; 70/312; 70/71

(58) Field of Classification Search ..... 70/284, 70/285, 312, 67, 69–71; 292/163
See application file for complete search history.

(56) References Cited

U.S. PATENT DOCUMENTS 1,979,560 A * 11/1934 Levine ..... 70/66
3,390,556 A * 7/1968 Constable ..... 70/75
3,408,839 A * 11/1968 Walters ..... 70/285
4,499,745 A * 2/1985 Ricouard et al. ..... 70/285
4,557,122 A * 12/1985 Hwang ..... 70/312
4,671,088 A * 6/1987 Jeang ..... 70/312
5,237,842 A * 8/1993 Rasch et al. ..... 70/285
5,485,734 A * 1/1996 Yang ..... 70/285
5,491,992 A * 2/1996 Mandall ..... 70/232
2005/0034492 A1 * 2/2005 Yu ..... 70/25

* cited by examiner

*Primary Examiner*—Patrcia Engle
*Assistant Examiner*—Alyson M Merlino

(57) ABSTRACT

The present invention provides a latch-type of lock 2 that includes an override mechanism to grant access to an article of luggage 1 by an override tool such as a master key. The present invention can be used on any type of storage facility and/or transport vessel including large storage containers, such as molded plastic storage and shipping boxes for linens and the like, briefcases, computer bags, messenger bags, backpacks, hard or soft-sided totes, hybrids, other molded or non-molded vessels, framed cases, unframed cases, and so on. The latch lock 2 of the present invention includes a mechanism for clearing a pathway 46, that, when the lock 2 is in a locked condition, is blocked. A pivot arm 12 is provided to block/unblock pathway 46. The pivot arm 12 is operated by a cam 10, which is in turn operated by the override tool. When the lock 2 has been overridden, the pivot arm 12 rotates out of pathway 46, thereby allowing lateral movement of a slider 6, which in turn allows displacement of a lever 8, thereby granting access to the contents of the luggage 1.

14 Claims, 5 Drawing Sheets

COMBINATION LOCK WITH PASS-KEY OVERRIDE

RELATED APPLICATIONS

This application claims the benefit of U.S. Application Ser. No. 60/662,565 filed Mar. 17, 2005 entitled "Combination Lock with Pass-Key Override."

FIELD OF THE INVENTION

The present invention relates to locks for luggage. More specifically, the present invention relates to latch locks that include an override mechanism to grant access, by a master key, to an appropriate entity, such as a security agency, a private organization, or other entity. The present invention can be used on any type of luggage case, including hard-side, soft-side, hybrid, unframed, molded, framed luggage cases, and any other type of luggage case.

BACKGROUND OF THE INVENTION

Travel today, and in particular, airline travel, has become much more complicated for the average consumer/traveler than it has been in the past. Instances like 9/11 and other terrorist attacks have led to increases in security within our nation's and the world's airports. Understandably, travelers and security officials alike conform to the more vigorous and strenuous security rules imparted by local airports. However, many travelers today still require an additional sense of security and therefore prefer to lock their luggage before abandoning it to board the aircraft. The benefits of locking one's luggage include deterring potential theft as well as protecting the suitcase from unexpectedly opening. To meet the needs of both the airline security and the consumer, locks have been developed to allow the airline security to override the locking mechanism, which may comprise a combination lock or any other locking mechanism, with a master key, thereby granting access to and inspection of the contents of the luggage without breaking the consumer's lock. Currently, such master key operable locks comprise combination locks that include a shackle. The shackle is entwined within zipper slider loopholes of the luggage case. Such shackle locks are usually applied to softside luggage cases that have zippers, instead of latches that can be found on hard-side cases. The shackle is then inserted into the mating portion of the combination lock, which can then be locked by applying a combination known only to the traveler. The base portion of some of these locks includes a "Transportation Security Administration" (TSA) key provision for security agency access. However, currently there are no provisions for an override combination lock that can be integrated into a hardside luggage case.

There is therefore a need for a latch-type combination lock that can be used on hardside luggage cases that incorporates an override feature such that travel security agencies around the world can access the contents of a traveler's locked luggage case without breaking the traveler's lock or disturbing the traveler's personal combination. The override mechanism should allow the lock to be opened, even when the combination is still in the locked position, and re-closed and relocked after security inspection has been completed. A further need exists for a universal latch lock that can be applied in either a left or right configuration to a luggage case.

BRIEF SUMMARY OF THE INVENTION

These goals have been achieved by the present invention, which provides a system and method of granting access to the contents of a luggage case to a travel security agency by bypassing a conventional user lock combination and foregoing the destruction of the lock. The term "luggage" herein is meant to include all types of storage and/or transport vessels including large storage containers, such as molded plastic storage and shipping boxes for linens and the like, briefcases, computer bags, messenger bags, backpacks, purses, hard side cases, soft side cases, hybrids, framed totes, unframed totes, and so on. The present invention incorporates these goals by providing a pivot arm that is operated by a cam, the pivot arm which rotates to create a blocked or an unblocked condition, wherein the blocked condition comprises blocking the movement of a slider, and the unblocked condition comprises allowing the movement of the slider so that a lever can be displaced, thus granting access to the interior of a luggage case.

The present invention therefore includes a latch lock, a housing for the latch lock, and both locking/unlocking and blocking/unblocking features. These features include a spring-loaded lever, a slider portion, a combination lock assembly, an override, a catch, and a cam and pivot arm assembly.

An advantage of the present invention is the simplicity by which the latch lock assembly may be manufactured, assembled, and attached to a hardside luggage case. Of course, the latch lock assembly can also be applied to structured (including hard-sided) briefcases and laptop carriers, as wells as other types of transport devices. The latch lock assembly can be mounted in left or right configuration on a case.

DETAILED DESCRIPTION

Figure 1:
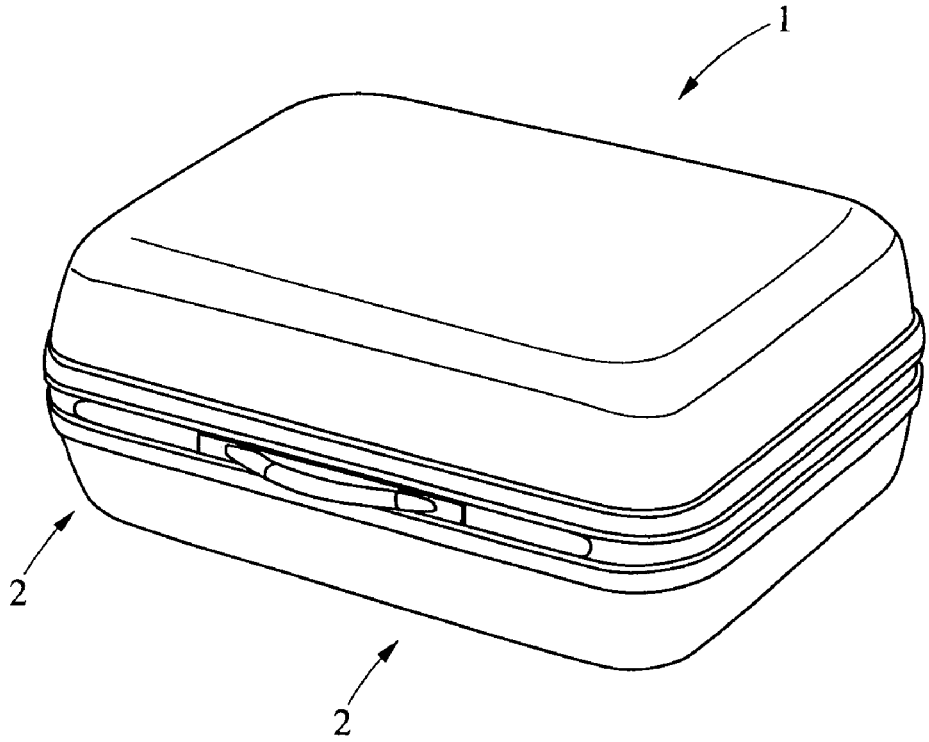
FIG. 1 is a perspective view of a hard-sided luggage case 1 of typical construction that incorporates the latch-lock 2.
Figure 2:
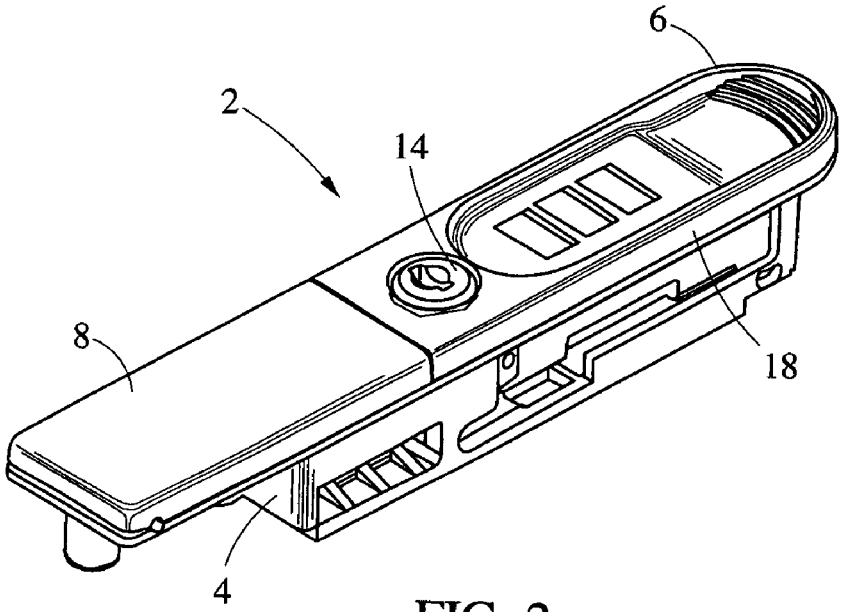
FIG. 2 is a perspective view of the latch-lock 2.

Referring to FIG. 1, a standard hard-sided luggage case 1 that is of typical construction known to those skilled in the art incorporates the latch 2 of the present invention. Referring to FIG. 2, an override feature in the form of a lock cylinder 14 is provided. Surrounding lock cylinder 14 in a semi-circular pattern are the symbols "TSA 002", indicating an override feature to travel security agents who can then use a master key (not shown) that matches lock cylinder 14 to unlock the case 1. The proper key corresponds to code 002. An otherwise conventional combination lock mechanism 18 is provided, allowing a user to set their own personalized combination.

Figure 3:
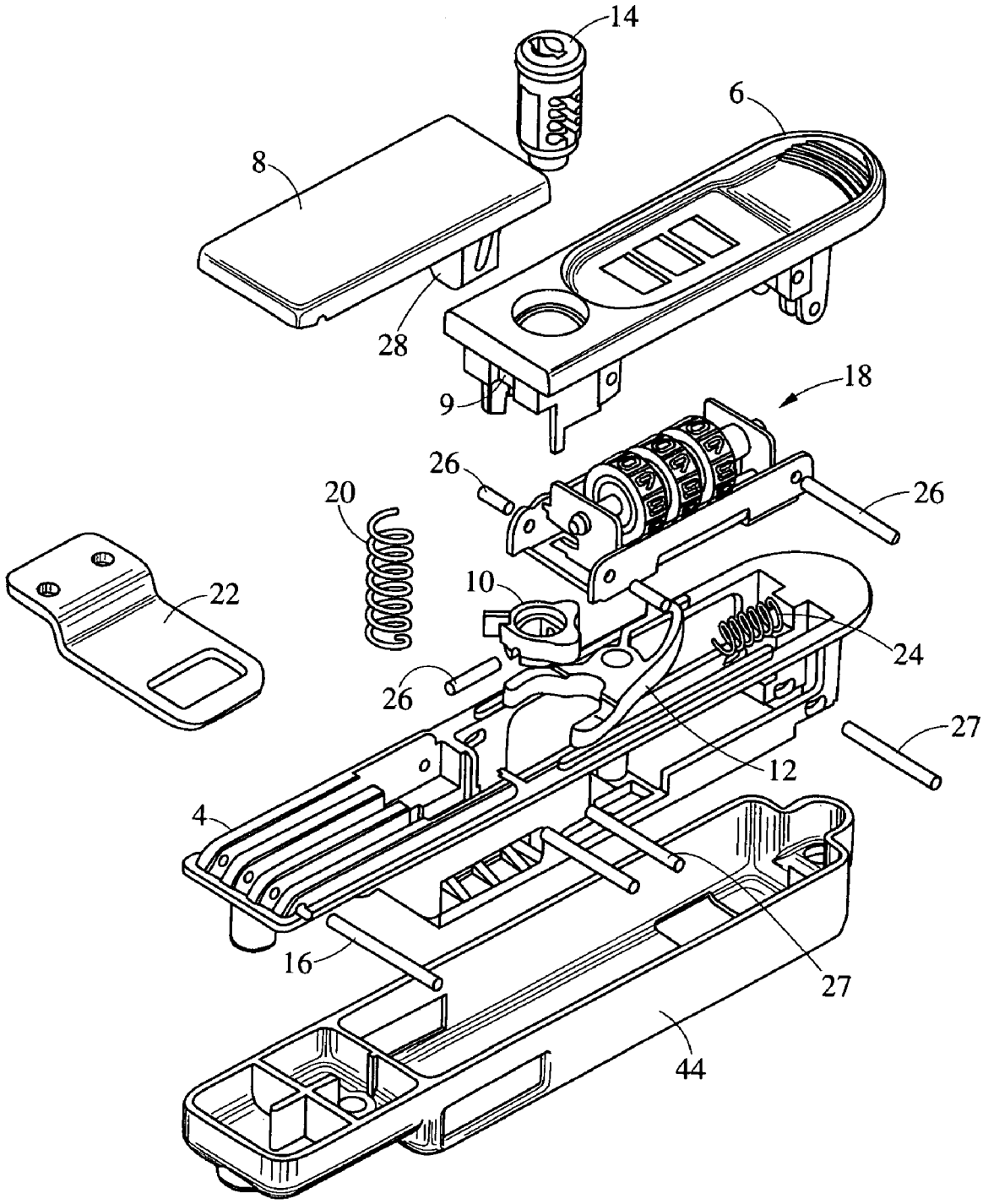
FIG. 3 is an exploded view of the latch-lock 2.

The lock 2 is shown in greater detail in FIG. 3. Looking to FIG. 3, the latch 2 is encased by housing 4. Housing 4 is of typical construction and is conventionally known in the art. Housing 4, and any component of the latch-lock 2, can comprise any material, including plastic, composite, metal alloy, or the like. A cover 44 envelops the housing 4 and is affixed to a recess along an edge of one of the shell halves of luggage case 1.

Figure 4:
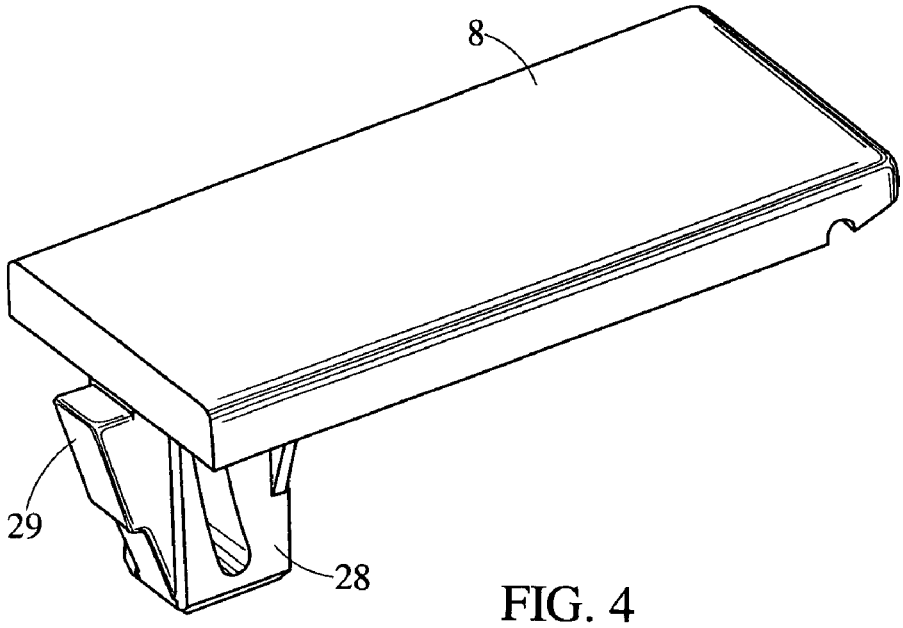
FIG. 4 is a perspective view of lever 8.
Figure 5:
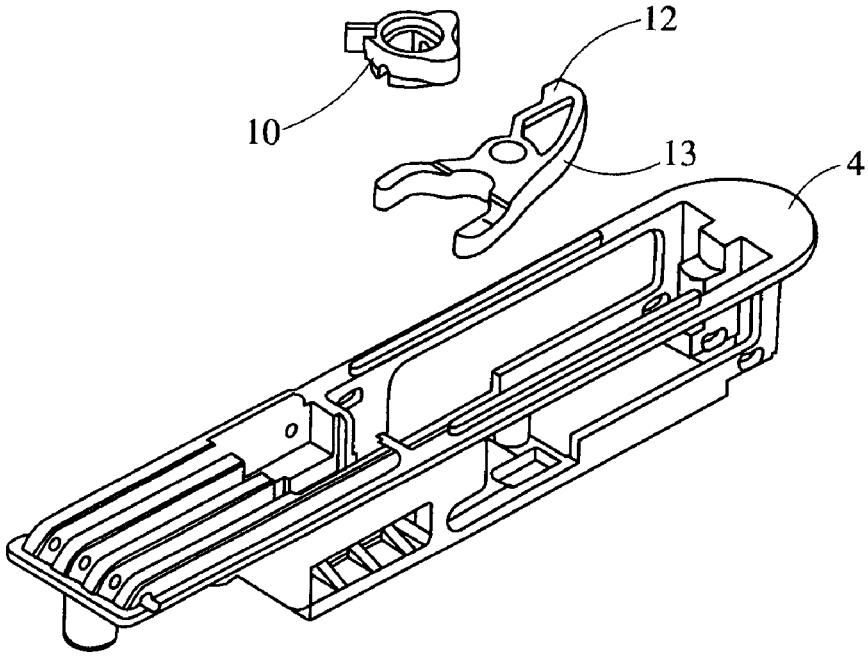
FIG. 5 is an exploded view of the housing 4, the pivot arm 12, and the cam 10 of the present invention.

Housing 4 acts as a base to a lever 8, also typically known in the art. Lever 8 includes a dagger 28, which extends perpendicular to lever 8 in a downward fashion towards the luggage case 1. As shown in FIG. 4, dagger 28 includes outcrop 29, that, when restricted, prevents lever 8 from being rotating outwardly from housing 4 in response to a biasing force provided by a lever spring 20. Lever spring 20 is situated directly adjacent dagger 28. In the latched (locked) condition, outcrop 29 is covered by slider 6. Slider 6 is mounted to housing 4 by a pair of slider pins 27 which in turn ride in small slotted openings in the housing 4 that permit the slider 6 to be forced to move against the bias of slider spring 26 a short distance to free lever 8, as will be detailed.

The slider 6 carries the combination lock assembly 18 attached thereto by pins 26. The slider 6 includes a notched portion 9 in its underside, out of view from the traveler. This notched portion 9 releases outcrop 29 when slider 6 is laterally moved away from lever 8. Then outcrop 29 is free to rotate upwardly along with the lever 8 due to the spring bias of lever spring 20. As lever 8 rises, dagger 28 releases a catch 22 which is carried by and projects from the other luggage case shell opposite that which houses the latch housing 4 and mechanism. Catch 22 includes a hole that engages dagger 28 when lever 8 is flush with housing 4, and releases dagger 28 when the lever is raised. During normal use by a traveler, the slider 6 is biased in a latched position by a slider spring 24. Thus, when latch 2 is unlocked or unblocked and slider 6 is forced away from lever 8, a sudden, audible "snap" can be heard when outcrop 29 is released. Slider 6 can be pushed away from lever 8 after setting the combination lock assembly 18 to its predetermined combination and achieving an unlocked condition. The case 1 can now be opened.

Figure 6:
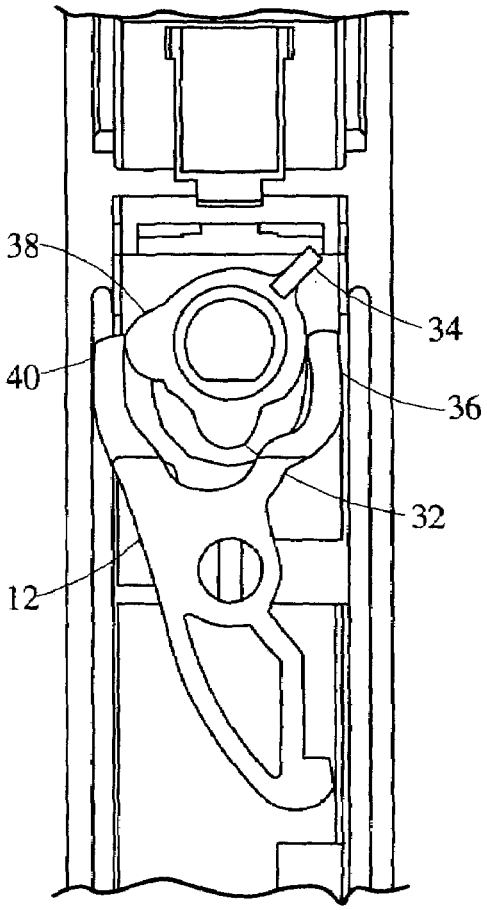
FIG. 6 is a close-up top view of the right-mounted pivot arm 12 in a blocking condition.
Figure 7:
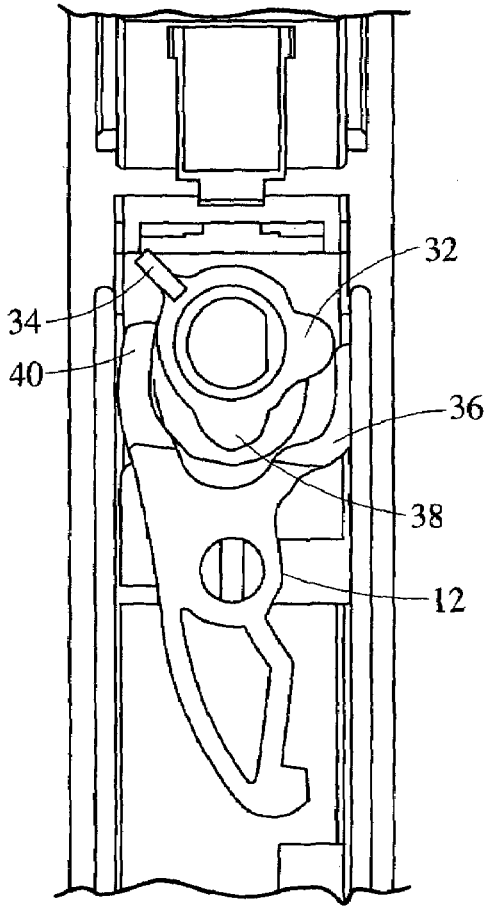
FIG. 7 is a close-up top view of the right-mounted pivot arm 12 shown in FIG. 6 in an unblocking condition.
Figure 10:
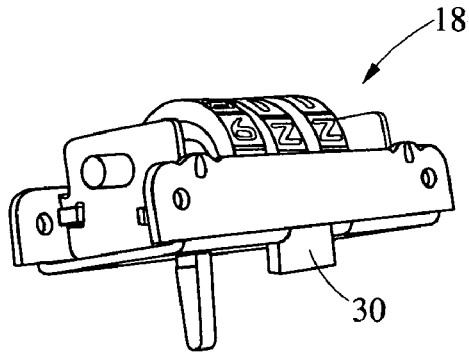
FIG. 10 shows the combination lock assembly of FIG. 9 in a locked condition.

The second way by which the luggage case 1 can be unlocked and opened is by overriding the latch 2. This is done by creating an unblocked condition of pivot arm 12. Referring to FIG. 6, a notched nose portion 13 of pivot arm 12 is positioned adjacent the inner wall of housing 4, creating a block (obstruction) to the location herein referred to as a "pathway 46". As shown in FIG. 7, the pathway 46 becomes unblocked when nose 13 rotates inwardly slightly. When pivot arm 12 is in a blocking condition, the lateral movement of combination lock assembly 18 is restricted, and lever 8 is prevented from upward displacement. Of course, when the combination lock 18 is in an unlocked condition, the latch 2 may be opened. However, the present invention provides for the latch 2 to be opened even when the combination lock assembly 18 is locked. Looking to FIG. 10, when the combination lock assembly 18 is in a locked condition, a restrictor 30 juts out of the combination lock assembly 18 according to normal actions typical of combination locks conventionally known in the art. By way of example, restrictor 30 is represented as a plate; however, it should be understood by one of ordinary skill in the art that restrictor 30 could comprise any device that would restrict the movement of slider 6. When the latch 2 is in a blocked condition, as was previously discussed with regard to the description of FIG. 6, nose 13 provides an obstruction to plate 30 in the pathway 46. Therefore, lateral motion of combination lock 18 fixed to the slider, and therefore slider 6 itself, is prevented. As a result, lever 8 movement is prohibited, and the case 1 remains locked because the dagger remains trapped in the aperture of the catch 22. When the pivot arm 12 has been rotated to an unblocked condition as shown in FIG. 7, the plate portion 30 of the combination lock assembly 18 is now free to move along pathway 46 because plate 30 is no longer obstructed by nose 13. In this way, even when the combination lock assembly 18 is locked and plate 30 would normally block the sliding motion of slider 6, the interior of the suitcase 1 can be accessed.

The method by which pivot arm 12 is moved includes some form of an override instrument, for example, a master key, in conjunction with the override mechanism of the present invention. While it is understood that the override mechanism could comprise any type of locking and unlocking device, by way of example, the override mechanism of the present invention includes lock cylinder 14. When a master key is inserted into lock cylinder 14 and the key is turned, lock cylinder 14 begins to rotate. Lock cylinder 14 fits within a cam 10. As the override key rotates lock cylinder 14, cam 10 also rotates. It is important to note that normally only the proper override key can activate motion of the cam 10, providing a level of security to travelers, as only very few security officials are given access to this special override key. Cam 10 thereby comprises a corresponding hollow opening to accommodate the lock cylinder 14. The cam 10 includes cam lobes 32 and 38 and restrictor 34. Restrictor 34 comprises a protrusion that prevents the cam 10 and lock cylinder 14 from rotating 360 degrees. When the override key is inserted into the lock cylinder 14 and the key is turned, the cam 10 correspondingly turns with the lock cylinder 14. As cam 10 rotates in the appropriate direction as shown in FIG. 7, a right-most cam lobe 32 pushes against a right-most arm 36 of pivot arm 12. This contact causes nose 13 of pivot arm 12 to rotate inwardly from the wall of the inside surface of housing 4 towards the center portion of housing 4, creating an unobstructed pathway 46 between nose 13 and wall of housing 4. The unobstructed corridor or pathway 46 allows plate 30, and therefore the entire combination lock assembly 18, to move laterally with the slider 6, effecting the upward displacement of lever 8 and accessibility into the luggage case 1. A similar sequence of events occurs when cam 10 is rotated in the opposite direction. To reestablish a blocking condition of pivot arm 12, the cam 10 is rotated in the opposite direction by rotating the override key in the opposite direction, the opposite rotation of cam 10 which causes contact between a left cam lobe 38 and left-most arm 40, causing rotation of pivot arm 12 such that the previously passable pathway 46 is now obstructed or blocked.

Figure 8:
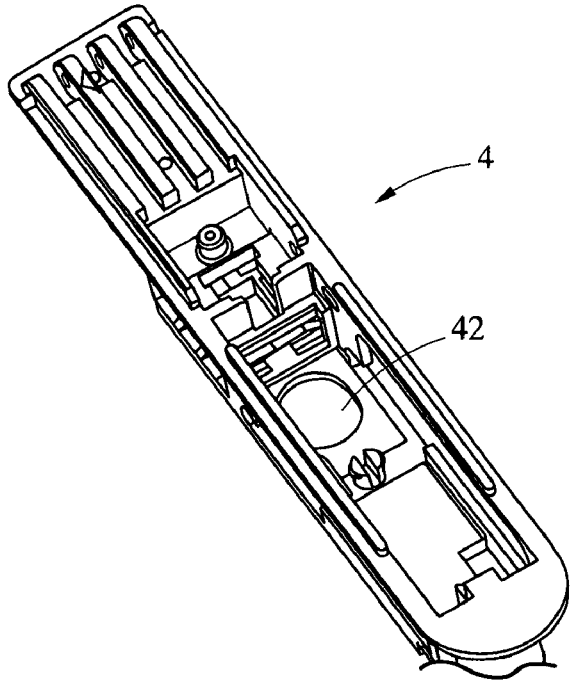
FIG. 8 is a perspective top view of the housing 4.
Figure 9:
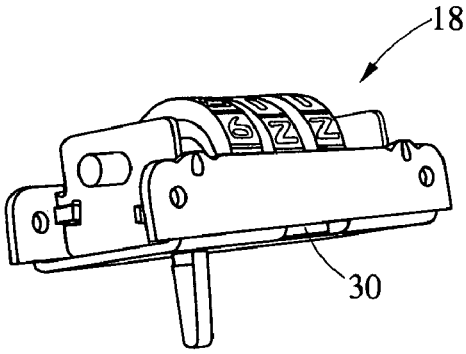
FIG. 9 is a perspective view of the combination lock assembly 18 in an unlocked condition.

An advantage of the present invention is that the override mechanism, or master key, cannot be removed from the lock 2 until the override mechanism has returned the lock 2 to a locked condition. Thus, a fail-safe method is provided for returning the luggage case 1, after inspection, to its original, secure state. A further advantage of the present invention is the snap assembly method by which pivot arm 12 is affixed to housing 4. Thus, in order to switch the configuration from a right-handed latch to a left-handed latch, the pivot arm 12 and an appropriately-dimensioned cam 10 need simply be removed and overturned, so that the notched nose portion 13 now butt up against the opposite inner wall of housing 4. Of course, left and right configurations can be achieved in other ways that are typical of the art. For example, in another embodiment of the present invention, one could imagine a reversal of a left/right configuration by overturning the pivot arm 12, inserting a mirror-image cam 10 into the housing 4, and rotating the master key in an opposite direction. In addition, pivot arm 12 could be affixed to housing 4 by other means, including permanent means. Housing 4 accommodates the left and right-most arms, 40 and 36 respectively, of pivot arm 12 by accommodating the arms within the thickness of housing 4. That is, housing 4 includes notches machined therein to accommodate right-most arm 36 and left-most arm 40. Housing 4 also includes a shallow indentation 42. As shown in FIG. 8, indentation 42 allows for the lateral motion of lock cylinder 14 when the slider 6 is laterally moved. Indentation 42 also accommodates the height of lock cylinder 14 while the latch lock mechanism 2 is in a locked position.

The present invention therefore provides a method and system for overriding a combination latch 2 by providing a specialized override mechanism that can be activated by only a specialized, regulated agency, such as an airport travel security agency.

Although the present invention has been described with a certain degree of particularity, it is understood that the present disclosure has been made by way of example, and changes in detail or structure may be made without departing from the spirit of the invention as defined in the appended claims.

What is claimed is:

1. A method of overriding a combined latch-lock and conventional locking mechanism assembly for use on an article of luggage, said latch-lock including a latch slider capable of moving along a pathway between a latched position and an unlatched position, said slider being normally biased in a latched position along said pathway, comprising the step of:

providing a pivot arm having two positions, which upon rotation pivots between a blocked condition and an unblocked condition, wherein said blocked condition comprises the obstruction of said pathway by at least a portion of said pivot arm, and said unblocked condition comprises the clearance of said pathway, and operating said pivot arm to unblock said pathway, thus permitting said latch slider to move along said pathway to said unlatched position, such that upon operating said pivot arm from a blocked condition to an unblocked condition said slider may be moved along said pathway towards said unlatched position, wherein said step of pivoting said pivot arm into an unblocked condition further comprises providing a cam, at least a portion of said cam being in engagement with at least a portion of said pivot arm, and rotating said cam, said step of rotating said cam further comprises providing an override mechanism that is in intimate engagement with said cam, and operating said override mechanism, wherein said step of operating said override mechanism comprises providing a lock cylinder concentric to said cam, and employing a master key to rotate said lock cylinder, and further providing a lever, said lever becoming separated from said slider upon said lateral movement of said slider.

2. The method of claim 1 wherein said step of separating said lever comprises moving said lever, that is normally biased in an unlocked condition, from a plane shared with that of said slider, said lever disengaging from a catch located on the adjacent half of said article of luggage, allowing the article to be opened.

3. The method of claim 1 wherein said step of moving said slider comprises manually moving said slider against said biasing force.

4. A method of overriding a combined latch-lock and conventional locking mechanism assembly for use on an article of luggage comprising the step of:

providing a pivot arm, providing a manually displaceable slider that is biased in a locked condition, providing a cam that is intimately engaged with at least a portion of said pivot arm, providing an override mechanism, manually displacing the slider, providing a pathway, clearing said pathway by pivoting said pivot arm thus creating an unblocked condition so that said slider can be moved in a lateral direction, said pivoting said pivot arm is accomplished by rotating said cam using said override mechanism, wherein said step of overriding said lock further comprises providing a lever, normally in intimate engagement with said slider, that ejects upon said displacement of said slider.

5. The method of claim 4 wherein the step of using said override mechanism includes employing a lock cylinder and master key.

6. The method of claim 4 further comprises providing a catch that becomes disengaged with said lever upon the ejection of said lever.

7. A system for overriding a combined latch-lock and conventional locking mechanism assembly for use on an article of luggage comprising:

a pivot arm having two positions, which upon rotation pivots between a blocked condition and an unblocked condition, wherein said blocked condition comprises the obstruction of a pathway by at least a portion of said pivot arm, and said unblocked condition comprises the clearance of said pathway, a manually displaceable slider that is biased in a locked condition, wherein displacement of said slider causes erection of a lever, said lever normally restricted by said biasing force on said slider, and by a dagger, integrally formed into an under surface of said lever, that is in engagement with a notch congruent with an under surface of said slider, wherein said slider includes an override mechanism and a combination lock.

8. The system of claim 7 wherein said combination lock includes a restrictor, said restrictor restricting the displacement of said slider when said combination lock is in a locked condition.

9. The system of claim 8 wherein lateral motion of said slider is achieved during said locked condition of said combination lock by pivoting said pivot arm, said pivot arm being pivoted by said a cam.

10. The system of claim 9 wherein said cam, having engagement with at least a portion of said pivot arm, is rotated by said override mechanism.

11. The system of claim 7 wherein said override mechanism comprises a lock cylinder and master key.

12. The system of claim 7 wherein said lever is normally biased in the erect position.

13. The system of claim 7 further comprising a cover that encases said system within one half of said article of luggage.

14. The system of claim 13 wherein said lever, upon ejection from a plane that is of the same as said lever, releases a catch that is attached to the other half of said article of luggage, allowing said article to be opened.

* * * * *